United States Patent [19]

Nenno et al.

[11] Patent Number: 4,759,906

[45] Date of Patent: Jul. 26, 1988

[54] FUNCTION ALLOY AND METHOD OF PRODUCING THE SAME

[75] Inventors: Soji Nenno, Suita; Kazuyuki Enami, Itami; Kazuhiko Hayashi, Osaka, all of Japan

[73] Assignee: Sumitomo Electric Industries, Ltd., Osaka, Japan

[21] Appl. No.: 10,757

[22] Filed: Feb. 4, 1987

[30] Foreign Application Priority Data

Mar. 12, 1986 [JP] Japan ..... 61-55900

[51] Int. Cl.[4] ..... C22C 5/04; C22C 30/00

[52] U.S. Cl. ..... 420/463; 148/402; 420/588

[58] Field of Search ..... 420/463, 464, 465, 588; 148/402

[56] References Cited

U.S. PATENT DOCUMENTS 3,220,828 11/1965 Kaarlela ..... 420/588

3,832,243 8/1974 Donkersloot et al. ..... 148/402

FOREIGN PATENT DOCUMENTS 262929 12/1985 Japan ..... 148/402

OTHER PUBLICATIONS

Chemical Abstracts, vol. 100, No. 12, Mar. 19, 1984, p. 266, Abstract No. 90006s, Columbus, Ohio, US; & JP-A-58-189 343 (Furukawa Electric Co., Ltd.) 05-1-1-1983, *Whole abstract*.

Chemical Abstracts, vol. 99, No. 26, Dec. 26, 1983, p. 281, Abstract No.: 216974n, Columbus, Ohio, US; Sivokha et al.: "Martensitic Transformations and the Shape Memory Effect in Alloys of the Titanium-Nickel-Palladium, (Tio.5Nio.5xPdx) System", & Fiz. Met. Metalloved., 1983, 56(3), 542-6, *Whole abstract*.

Journal of the Less-Common Materials, 20 (1970), 83-91, Table II, FIGS. 4 and 5.

Japan Institute of Metals Autumn Meeting Preparatory Manuscript, (1985, 10).

*Primary Examiner*—L. Dewayne Rutledge

*Assistant Examiner*—Robert L. McDowell

*Attorney, Agent, or Firm*—W. G. Fasse; D. H. Kane, Jr.

[57] ABSTRACT

A method of producing functional alloys by adding not more than 20 atomic percent Cr to a TiPd alloy with 40-60 atomic percent Ti which develops thermoelastic martensitic transformation, for adjusting the transformation point of the alloy. Such a functional alloy may comprise in addition to the Ti, 0.001-20 atomic percent Cr, the balance being Pd.

3 Claims, 1 Drawing Sheet

FUNCTION ALLOY AND METHOD OF PRODUCING THE SAME

BACKGROUND OF THE INVENTION

1. Field of the Invention

This invention relates to a functional alloy which develops such effects as a shape memory effect, a superelasticity, and a damping effect.

2. Description of the Prior Art

Among well-known functional alloys which develop a shape memory effect, a superelasticity or a damping effect are Au-Cd, Cu-Zn-Al, Cu-Al-Ni, and Ti-Ni type alloys. Some of these functional alloys have been put to practical use but the upper limits of temperatures at which they can develop a shape memory effect are at most 100° C. Thus, so far as the above alloys are used, it has been impossible to produce an alloy which restores its shape at high temperatures above several hundred degrees. Sometimes, to increase the transformation temperatures, various elements are added to these alloys, but heretofore a remarkable result has not been obtained.

Among various functional alloys, TiNi type alloys are superior in corrosion resistance. However, TiNi alloys have a drawback that their plastic workability is poor. Further, at present when a sufficient investigation of the carcinogenic effect of Ni ions on human tissue has not yet been made, there is a problem in the embedding of NiTi alloys as they are, in human bodies. Thus, when TiNi alloys are used as an implanting material for orthopedics, they must be coated.

On the other hand, as described in a variety of publications, such as the "Journal of the Less-Common Materials", 20 (1970) 83–91, Table II, FIGS. 4 and 5 and "Japan Institute of Metals Autumn Meeting Preparatory Manuscript" (1985, 10), it is known that near-equiatomic TiPd alloys have a martensitic transformation start temperature (hereinafter referred to simply as the Ms point) of 510° C. and that they have a shape memory effect. Thus, if said TiPd alloys are used, it is possible to produce an element which restores its shape at high temperatures in the vicinity of 500° C. However, no functional alloy which develops a shape memory effect at suitable temperatures between 100° C. and 510° C. has been put to practical use.

SUMMARY OF THE INVENTION

Accordingly, an object of the invention is to provide a method of producing a functional alloy whose Ms point can be set at any desired temperature in a broad temperature range, particularly in a temperature range from the liquid nitrogen temperature (−196° C.) or thereabouts to 510° C. or thereabouts.

Another object of the invention is to provide a functional alloy which is superior in corrosion resistance and plastic workability.

We have found that the addition of Cr to a near-equiatomic TiPd alloy monotonously lowers the Ms point of the alloy with an increase in the amount of Cr added. The invention is based on this finding.

A method of producing functional alloys according to the invention is characterized by adding not more than 20 atomic percent Cr to a TiPd alloy with 40–60 atomic percent Ti which develops thermoelastic martensitic transformation, thereby adjusting the transformation point of said alloy.

Function alloys obtained by the invention have 40–60 atomic percent Ti and 0.001–20 atomic percent Cr, the balance being Pd.

Since Ti and Pd are superior in corrosion resistance, TiPd alloy having these elements as their principal components are also superior in corrosion resistance. The addition of Cr to these TiPd alloys makes it easier for them to have a passive film formed thereon and imparts better corrosion resistance and oxidation resistance to them than those of binary alloys. The addition of Cr also improves the plastic workability of the alloys. Particularly, it improves hot workability as well as oxidation resistance. Further, Ti and Pd, which are the principal components of said functional alloys, have long been used as dental materials and have proved to be safe to human bodies. For this reason, there is no problem involved in using functional alloys whose principal components are Ti and Pd for medical purposes.

In near-equiatomic TiPd alloys, if the alloy has a composition with 40–60 atomic percent Ti, the intermetallic compound phase expressed as TiPd is the principal component phase for developing a shape memory effect. Compositions with the Ti concentration lying outside said range do not develop a satisfactory shape memory effect. A more preferable Ti concentration range is from 45 to 55 atomic percent. With such compositions, the martensitic phase tends to be stable, resulting in ready development of a shape memory effect.

If the concentration of Cr to be added is not more than 20 atomic percent, all Cr will dissolve in the TiPd intermetallic compound phase in the solid state without spoiling the shape memory effect of the alloy. As the amount of Cr to be added increases, the Ms point of the functional alloy changes. Therefore, by suitably selecting the amount of Cr to be added, it is possible to set the Ms point of functional alloys at any desired temperature from 510° C. or thereabouts to the liquid nitrogen temperature (−196° C.) or thereabouts.

The reason for setting the lower limit of the atomic concentration of Cr at 0.001% is that with the concentration below the lower limit, the effect of the addition of Cr will not develop so that there is no difference between the alloy under consideration and TiPd binary alloys.

Reversely, if the Cr content exceeds 20 atomic percent, the transformation point will be in the cryogenic temperature region, a fact which is meaningless from a practical point of view. Further, the alloy will become brittle and it will be difficult to process into a desired shape. A more preferable Cr content is 0.2–12 atomic percent. With the Cr concentration maintained in this range, oxidation resistance and workability will be remarkably improved. Improvements in oxidation resistance and workability are substantially saturated at 12 atomic percent.

It follows from the above that a more preferable component ratio for a functional alloy according to the invention is 45–55 atomic percent Ti and 0.2–12 atomic percent Cr, the balance being Pd. With such component ratio, the Af point (the temperature at which the transition to the austenitic phase is completed of the functional alloy is in the range of 80° C. to 470° C. Heretofore, there has not been a suitable functional alloy having the Af point in such range.

In addition, functional alloys obtained according to the invention undergo thermoelastic martensitic transformation; thus, as is well-known in the art, they will develop a shape memory effect and, furthermore, they also develop a superelasticity at temperatures not less than the reverse transformation completion temperature and a damping effect at a temperature in the vicinity of the Ms point.

According to the method of the invention, by suitably selecting the Ti, Pd and Cr contents, the transformation point of the alloy can be controlled at will between 510° C. or thereabouts and the liquid nitrogen temperature (−196° C.) or thereabouts. Therefore, an element which can be operated in a broader temperature range is obtained than when known functional alloys are used. Conventional Ti-Ni type functional alloys cannot be utilized as sensors or actuators which must operate at a temperature above 100° C. However, according to the invention, functional alloys which are suited for such applications can be easily obtained.

Further, functional alloys according to the invention having Ti and Pd, which are superior in corrosion resistance, as their principal components, and Cr added thereto; develop a satisfactory corrosion resistance, oxidation resistance and plastic workability. Since functional alloys according to the invention do not contain Ni, as an alloying element, which is liable to be carcinogenic, they can be utilized for medical purposes, particularly as implanting materials for orthopedics.

These objects and other objects, features, aspects and advantages of the present invention will become more apparent from the following detailed description of the present invention when taken in conjunction with the accompanying drawings.

DESCRIPTION OF PREFERRED EMBODIMENTS AND OF THE BEST MODE OF THE INVENTION

EXAMPLE 1

Figure 1:
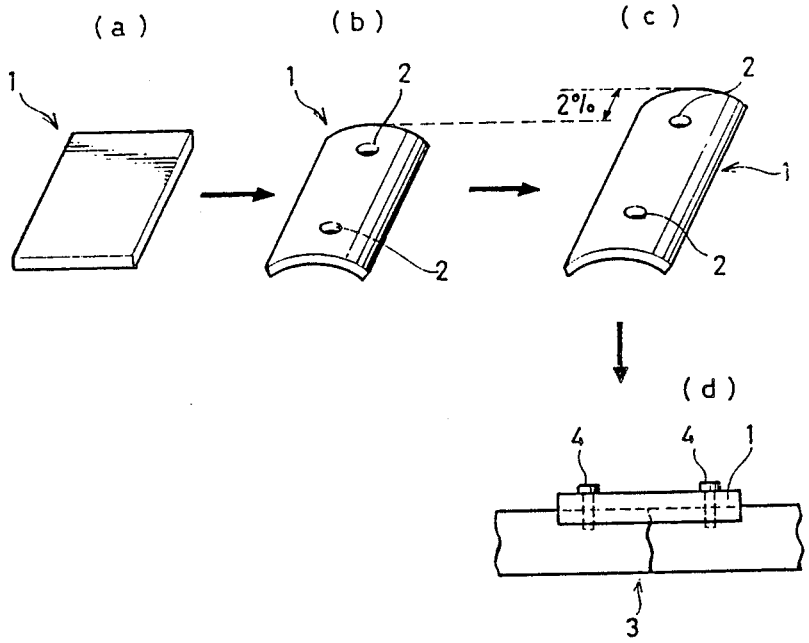
FIG. 1 is a view for explaining an example, illustrating processing steps for preparing a rolled plate for use as a bone plate.

Cr was added to a TiPd alloy to investigate the influence of Cr addition on the martensitic transformation.

With the Ti concentration maintained at 50 atomic percent, the atomic concentrations of Pd and Cr were varied to prepare the following 7 samples.

| | Atomic Concentration (%) | | | |
|---|---|---|---|---|
| | Ti | Pd | Cr | Ms Point (°C.) |
| Sample A | 50 | 50 | 0 | 510 |
| Sample B | 50 | 45 | 5 | 274 |
| Sample C | 50 | 43 | 7 | 156 |
| Sample D | 50 | 42 | 8 | 93 |
| Sample E | 50 | 41.5 | 8.5 | 50 |
| Sample F | 50 | 41 | 9 | 13 |
| Sample G | 50 | 40 | 10 | not more than −100 |

For production of alloys, commercially available Ti plates, Pd plates and electrolytic chromium (each being of 99.9% purity) were used, and they were arc-melted in an argon atmosphere, providing 10–12 g of buttons. Such a button was heated to 1,000° C. in said argon atmosphere and then hot rolled to form a 0.5 mm thick plate. An electric resistance measuring sample and an electron microscope examination sample were cut out of the rolled plate, and finally the samples were sealed in a transparent quartz tube filled with argon for annealing at 1,100° C. for 10 minutes, followed by quenching. Measurements of the Ms point were made by measuring the electric resistance using the four-terminal network method. Electron microscopic examination were made using a Hitachi Mode H800-T electron microscope.

As is clear from the table shown above, it is seen that the Ms point monotonously lowers as Cr increases.

EXAMPLE 2

Commercially available Ti plates, Pd plates and electrolytic Cr were melted by the non-consumable electrode type arc melting method to produce an alloy composed of 50.0 atomic percent Ti, 49.0 atomic percent Pd and 1.0 atomic percent Cr. This alloy was hot-rolled at 1,000° C. to form a 0.5 mm thick plate which was then held straight in an argon atmosphere and annealed at 1,100° C. for 10 minutes and then quenched in water.

The transformation points of this alloy were measured by measuring the electric resistances, it was found that the Ms point was at 470° C. and the Af point, the temperature at which the austenitic phase transition is completed was 510° C.

To ascertain the shape memory effect of this alloy, the alloy was deformed by bending such that the maximum surface strain was 1% at room temperature, and then it was heated by a gas burner. Immediately, the alloy restored its original straight shape. The temperature for the alloy was 550° C. In addition, it was ascertained that the alloy exhibited the same behavior if the temperature at which is was previously deformed was not more than the Ms point or 470° C.

If the aforesaid test is conducted with conventional Ti-Ni alloys, the shape memory effect will be deteriorated since the flame temperature is too high. This accounts for the fact that it has been impossible to use conventional Ti-Ni alloys as actuator which operate by directly detecting the aforesaid high temperature. It is seen, however, that the alloy obtained in this example can be used as an actuator which operates by directly detecting the flame temperature.

EXAMPLE 3

FIG. 1 is a view for explaining Example 3. First, a plate material 1 composed of 49.0 atomic percent Ti, 39.0 atomic percent Pd and 12.0 atomic percent Cr, was prepared as shown at (a). The Ms point of this alloy was 25° C. and the Af point was 65° C. This plate material 1 was bent and drilled to form holes 2, as shown at (b). Maintained in the shape shown at (b), it was subjected to a shape memory treatment at 1,100° C. for 10 minutes.

Then, as shown at (c), the plate material 1 was given a 2% tensile deformation. Thereafter, the plate material 1 was used as a bone plate and attached to a broken bone area 3 by bolts 4, as shown at (d).

Upon completion of a surgical operation, the plate material 1 was heated from outside by high frequency induction heating. As a result the plate material 1 tended to contract and the broken bone was healed in a short time. In addition, there was found no abnormality in the human tissue around the bone plate.

EXAMPLE 4

A tape composed of 51.0 atomic percent Ti, 40.5 atomic percent Pd, and 8.5 atomic percent Cr was produced by the single roll method in a vacuum. The thickness of the tape was 0.2 mm. The Ms point of this alloy was 140° C. and the Af point was 180° C.

The tape thus obtained was used as a fuse which reliably operated at 200° C.

EXAMPLE 5

Figure 2:
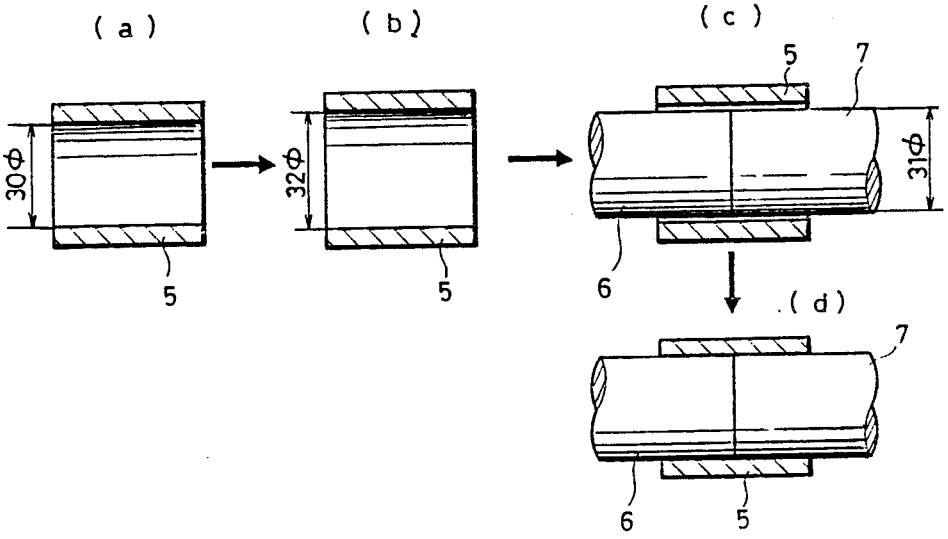
FIG. 2 is a view for explaining an example, illustrating processing steps for preparing a pipe section for interconnecting titanium pipes 6 and 7 inserted therein.

FIG. 2 is a view for explaining Example 5. An alloy composed of 50.0 atomic percent Ti, 32.0 atomic percent Pd, and 18.0 atomic percent Cr was processed into a pipe of 30 mm inner diameter as shown at (a) by hot swaging and cutting. The Ms point of this alloy was −90° C. and the Af point was −50° C. This pipe 5 was expanded in liquid nitrogen to have an inner diameter of 32 mm, as shown at (b). Titanium pipes 6 and 7 of 31 mm in outer diameter were inserted in said pipe 5 from opposite sides, as shown at (c), and the pipe 5 was brought back to room temperature. Thereupon, as shown at (d), the pipe 5 reduced in diameter and thereby reliably interconnected the titanium pipes 6 and 7.

EXAMPLE 6

A 5 mm-thick plate composed of 50 atomic percent Ti, 45.0 atomic percent Pd and 5.0 atomic percent Cr was hot rolled by a four-stage roll assembly to reduce the plate thickness to 3 mm. This rolling was easily performed without causing cracks.

For comparison, an attempt was made to likewise roll an alloy composed of 50.0 atomic percent Ti and 50.0 atomic percent Pd, but oxidation films grew fast and adhered to the rolls or edge cracking often occurred during the rolling.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A functional alloy, comprising 40–60 atomic percent of Ti, 0.001–18 atomic percent of Cr, and the balance being Pd, said functional alloy having a martensitic transformation temperature within the range of about −196° C. and about +510° C.

2. The functional alloy of claim 1, wherein Ti is within the range of 45–55 atomic percent, and Cr is within the range of 0.2–12 atomic percent, and the balance being Pd.

3. A method of controlling the martensitic transformation temperature of a functional alloy within a wide range, comprising the steps of:

(a) providing a TiPd alloy including 40 to 60 atomic percent of Ti, and (b) adding to said TiPd alloy chromium in the range of 0.001 to 18 atomic percent for producing thermoelastic martensitic transformations within a temperature range of about −196° C. to about +510° C.; the remainder being Pd.

* * * * *